United States Patent [19]

Köger et al.

[11] Patent Number: 4,526,506

[45] Date of Patent: Jul. 2, 1985

[54] RADIAL FAN WITH BACKWARDLY CURVING BLADES

[75] Inventors: Friedrich Köger, Neuenstein; Udo Haas, Hardheim, both of Fed. Rep. of Germany

[73] Assignee: Wilhelm Gebhardt GmbH, Waldenburg, Fed. Rep. of Germany

[21] Appl. No.: 565,656

[22] Filed: Dec. 27, 1983

[30] Foreign Application Priority Data

Dec. 29, 1982 [EP] European Pat. Off. ..... 82112081.3

[51] Int. Cl.[3] ..... F01D 3/02; F04D 29/38

[52] U.S. Cl. ..... 415/98; 415/102; 416/184; 416/185

[58] Field of Search ..... 415/98, 102, 87; 416/184, 199, 185, 186 R, 187

[56] References Cited

U.S. PATENT DOCUMENTS

| | | | |
|---|---|---|---|
| 1,246,090 | 11/1917 | Hagen | 416/186 R |
| 2,465,671 | 3/1949 | Van Millingen et al. | 416/184 |
| 4,093,401 | 6/1978 | Gravelle | 416/185 |
| 4,218,190 | 8/1980 | Nishikawa et al. | 416/186 R |

FOREIGN PATENT DOCUMENTS

| | | | |
|---|---|---|---|
| 2437001 | 2/1976 | Fed. Rep. of Germany | 416/186 R |
| 153997 | 9/1982 | Japan | 416/186 R |
| 0723706 | 2/1955 | United Kingdom | 416/186 R |
| 2063365 | 6/1981 | United Kingdom | 416/187 |

*Primary Examiner*—Robert E. Garrett
*Assistant Examiner*—H. Edward Li
*Attorney, Agent, or Firm*—Steven L. Permut; Malcolm L. Sutherland; Leon E. Redman

[57] ABSTRACT

A radial fan has airfoil-like, backwardly curved blades placed between a support plate and a cover plate. The blades are so formed that the blade entry angle on the cover plate side is 4° to 7° smaller than the blade entry angle on the support plate side and the blade exit angle on the cover plate side is 3° to 6° smaller than the blade exit angle on the support plate side. The blade entry angle on the cover plate side is between 14° and 20° and the blade exit angle on the cover plate side is between 39° and 45°. This form is produced by twist of the blades or twist-free deformation thereof.

23 Claims, 8 Drawing Figures

RADIAL FAN WITH BACKWARDLY CURVING BLADES

BACKGROUND OF THE INVENTION

The present invention is with respect to a radial fan made up of a spiral housing and a radial impeller therein, the impeller bearing blades running between a support plate and a cover plate having a rounded guide overlapping an inlet cowl of the fan. The blades are designed in the form of airfoils (for example like the section of an airplane wing) having inner edges that are at a slope in relation to the axis of turning of the radial impeller. The inner diameter of the blades becomes smaller from the cover plate to the support plate and the ratio of the mean inner diameter of the blades to the outer diameter thereof is about 0.7 to 1.

Such radial fans, that have come to be used in the art, may be looked upon as the last stage in a process of development whose purpose was that of designing such fans to have the highest possible power density or power to size ratio while at the same time having a good efficiency and an overload-proof characteristic curve. In giving a specification of such a fan dimensionless numbers or coefficients have been widely used, that take into account the well-known relation between the volumetric flow $\dot{V}$ and the increase in pressure $\Delta p_t$ and the diameter and the speed n of turning of the impeller and the density $\rho$ of the medium to be impelled. The volume number defined as $$\phi = \frac{4}{\pi^2} \cdot \frac{1}{D^3 \cdot n} \cdot \dot{V}$$

and the pressure number $$\psi_t = \frac{2}{\rho\pi^2} \cdot \frac{1}{D^2 \cdot n^2} \cdot \Delta p_t$$

put an end to these dependencies and made possible a direct comparison between radial fans with different size and performance data. A radial fan may be described by a characteristic curve in the form of $\psi_t$ against $\phi$. The optimum conditions of operation are produced at an optimum point characterized by the pair of values $\psi_{topt}$, $\phi_{opt}$, in which the efficiency $\eta$ of the radial blower is at its maximum $\eta_{max}$. As a measure for the compactness of the radial fan the power density at the optimum point, that is to say the product of $\psi_{topt}$ and $\phi_{opt}$ may be used. Measured in terms of these magnitudes surprising results may be produced with the said form of fan in keeping with the prior art. At an efficiency of $\eta_{max}$ of 0.85 $\psi_{topt}$ is 0.91 and $\phi_{opt}$ is equal to 0.2 so that the power density takes on a value of 0.182. This high power density, which comes near to the power density of a drum impeller fan with forwardly curving blades, is even as such representative of a very compact radial fan. For one and the same field of use it makes it possible for a fan to be fitted with an impeller having backwardly curved blades or with a drum impeller, while the size of the spiral housing and the diameter of the impeller are kept unchanged in size. This in turn makes it possible for the fans to be standardized and to be mass produced on a large scale, so that one may say that a great step forward is now possible in the ventilating and air conditioning arts.

GENERAL OVERVIEW OF THE PRESENT INVENTION

One purpose or object of the invention is to make a better design of a radial fan of the sort named while at the same time keeping the useful effects produced so far. In this respect the power density at the optimum point is to be stepped up to a value greater than 0.2, while on the other hand the volume number or coefficient is not to go under 0.2 and the efficiency is to be 80% and over. These requirements are in effect representative of an even more compact design of such a radial fan with the same or an even lower power requirement so that the fan is in keeping with the most exacting demands with respect to economy in the use of energy and profitability of plant. Furthermore any differences between the volume number $\phi$ and $\phi_{opt}$ are to be possible with only the least possible change for the worse in the efficiency $\eta$. In terms of a diagram in which the efficiency $\eta$ is plotted as a function of the volume number $\phi$ one would then do one's best to get the lowest possible decrease in the efficiency $\eta$ in a working range about $\phi_{opt}$. More specially, in the present invention a broadening out of the volume number range is to be made possible, in which $\eta$ is equal to at least 80%. In effect this requirement is in keeping with the possibility of running a radial fan in keeping with the invention at a high efficiency even at operation points along its $\phi - \psi_t$ characteristic, that are clear of the optimum point. In this case the selection of fans for fitting in a pre-existing plant is made simpler and the series of types necessary for meeting likely conditions of operation may be kept small in number.

For effecting these and further purposes a radial fan is so designed in the invention that the blade entry angle on the cover plate side is 4° to 7° smaller than the blade entry angle on the support plate side and the blade exit angle on the cover plate side is 3° to 6° smaller than the blade exit angle on the support plate side and the blade entry angle on the cover plate side is between 14° and 20° and the blade exit angle on the cover plate side is between 39° and 45°.

Twisted blades in the form of airfoils for use a blades in fans have been noted in the German Pat. No. 952,547, in which it was said that the entry edges of the blades might be skew and not parallel to the axis of the impeller. However, unlike the teaching of the present invention, in the said patent the blade entry and exit angles were to be greater on the cover plate than on the support plate side; the purpose of the present invention would not be effected with such a design. Curved or arched blades of like design are furthermore to be seen in the German Auslegeschrift specification No. 1,057,725, which furthermore is to the effect that such blades might be curved in the opposite direction and might be in the form of streamlined, airfoil-like structures. However there is nothing said in this earlier specification about keeping to the linear and angle ranges that are of key importance in the present invention.

Further useful effects and details of the invention will be seen from the account now to be given of some working examples using the figures herein.

LIST OF DIFFERENT VIEWS OF THE FIGURES

DETAILED ACCOUNT OF SOME WORKING EXAMPLES OF THE INVENTION

Figure 1:
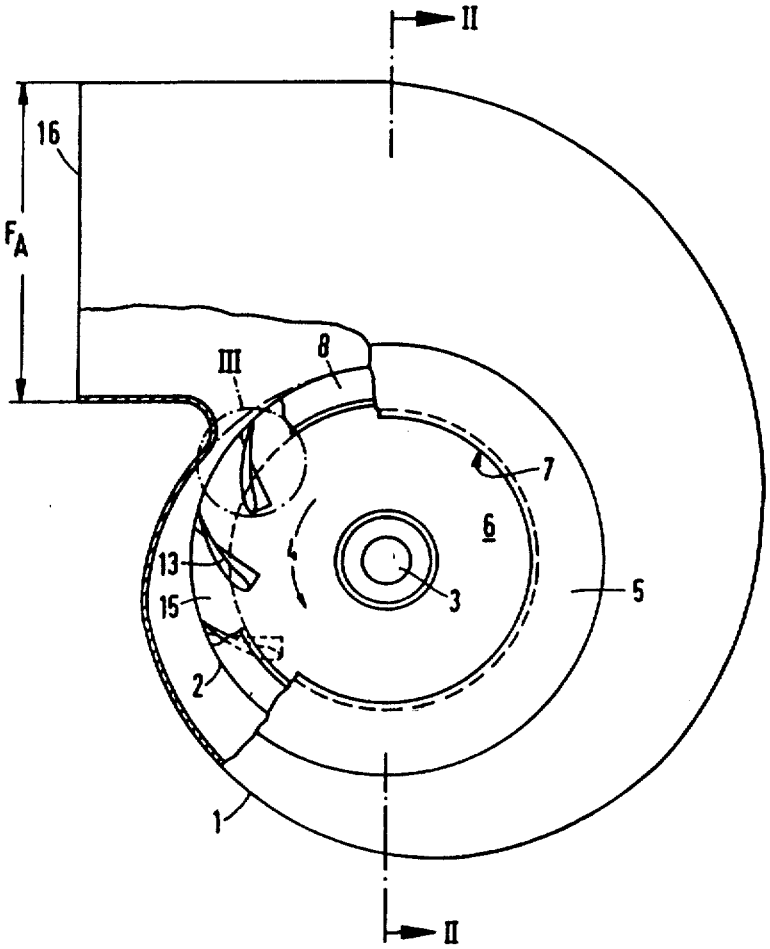
FIG. 1 is a plan and partly broken away view of a radial fan in keeping with the present invention.

On looking first at FIG. 1 it will be seen that a radial fan in keeping with the present invention has a spiral housing 1, in which a radial impeller 2 is fitted. The said impeller 2 is supported on a shaft 3. It is turned by a drive (not figured) in the direction of the arrow 4. When this takes place the fluid that is to be transported or moved by the fan is aspirated in the axial direction, that is to say in the axial direction of the shaft 3 so that such fluid is taken up into the spiral housing 1 and is then forced outwards therefrom in a radial direction. The said fluid makes its way into the inside of the spiral housing 1 through an inlet nozzle or cowl 5. For this purpose the said cowl 5 is placed to the side on the spiral housing and it takes the form of a collar placed round the edge of an inlet opening and becoming narrower in an inward direction like a funnel. The inner edge 7 of the inlet cowl 6 in this respect takes the form of a generally cylindrical sleeve, the same forming a part of the inlet cowl 5 overlapping a cover plate 8 forming a casing round the radial impeller 2. In this respect the inlet cowl 5 will be seen to be placed radially within the cover plate 8. Between the inlet cowl 5 and the part 9 overlapping same of the cover plate 8 there is a gap 10. Starting from the overlapping part 9 the cover plate 8 will be seen to be running outwards in the form of a curved contour or guide 11 in a radially outward direction. The guide 11 comes to an end at the top side 12 of a number of blades 13, which for their part have their lower side 14 fixed on a support plate 15 of the radial impeller 2. In keeping with the present invention the blades are backwardly curved and in the form of airfoils, of which more details will be given hereinafter. The fluid aspirated into the radial impeller 2 by way of the inlet cowl 5 is forced by the blades 13 in a radial direction and guided in the spiral housing 1 out towards an outlet area with a more specially rectangular cross section, the fluid then moving out of the radial fan through said area.

Figure 2:
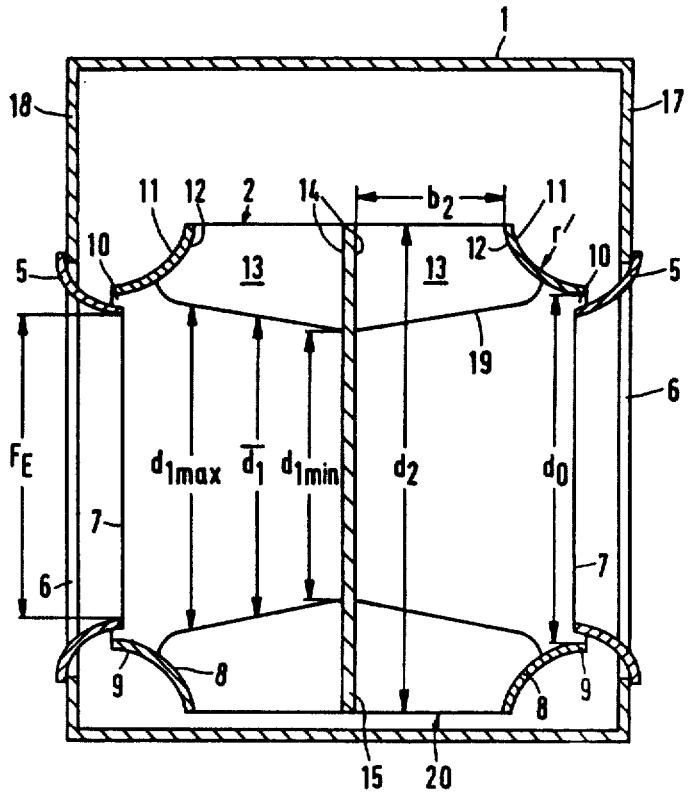
FIG. 2 is a section through the impeller of the radial fan taken on the line II—II of FIG. 1, in which, to make the figure more straightforward, only one pair of blades on each half of the impeller is to be seen without the shaft being figured.

Turning now to FIG. 2, the reader will see a form of the fan of the present invention designed for aspiration of the fluid on both sides, such fan being more specially used for fitting in air conditioning units and plant. In this case the radial fan is symmetrical about a middle plane, in which the support plate 15 of the radial impeller 2 is placed. The support plate 15 is fitted on both sides with blades 13, which on their top sides 12 are in each case covered over by a cover plate 8. Each of the inlet cowls 5 has a round guide 11 overlapping with the inlet cowl next thereto, there then being a space therebetween in the form of a gap 10. Each of the sides of the radial impeller 2 on the support plate 15 does for this reason have an aspirating effect in the axial direction, such aspiration causing flows of fluid, heading towards each other, to be moved through the side walls 17 and 18 into the radial fan. The flows of fluid are forced outwards in a radial direction into the common spiral housing 1. They come out of it by way of an outlet area 16. The sides of the radial impeller 2 are in this design made completely symmetrical; dimensions marked in FIG. 2 on the one half only are for this reason used in the other half or sides of the radial fan as well. On the same lines the outline of the blades 13 is the same on the two halves of the radial impeller 2.

An account will now be given of the outline or contour of the blades 13. It will firstly be seen from FIG. 2 that the inner diameter of the blades, that is to say the diameter of a circle centered on the impeller shaft so as to be touching the inner edges 19 of the blades 13 becomes smaller from the cover plate 8 to the support plate 15. Let ($d_{1max}$) be the maximum value of the inner diameter of the blades as measured at the cover plate 8. Then for the average blade inner diameter $\overline{d_1}$ we have $$\overline{d_1}=(d_{1min}+d_{1max})/2.$$

As the reader will see from FIG. 2, the inner edges 19 of the blades are on a surface of rotation centered on the axis of turning of the radial impeller 2, said surface becoming narrower like a funnel from the cover plate 8 towards the support plate 15. The surface of rotation thought of as having the outer edges 20 of the blades on it is on the other hand cylindrical. The outline or outer contour of the blades 13 may for this reason be described over its full height between the cover plate 8 and the support plate 15 in terms of a generally constant blade outer diameter $d_2$.

Figure 3:
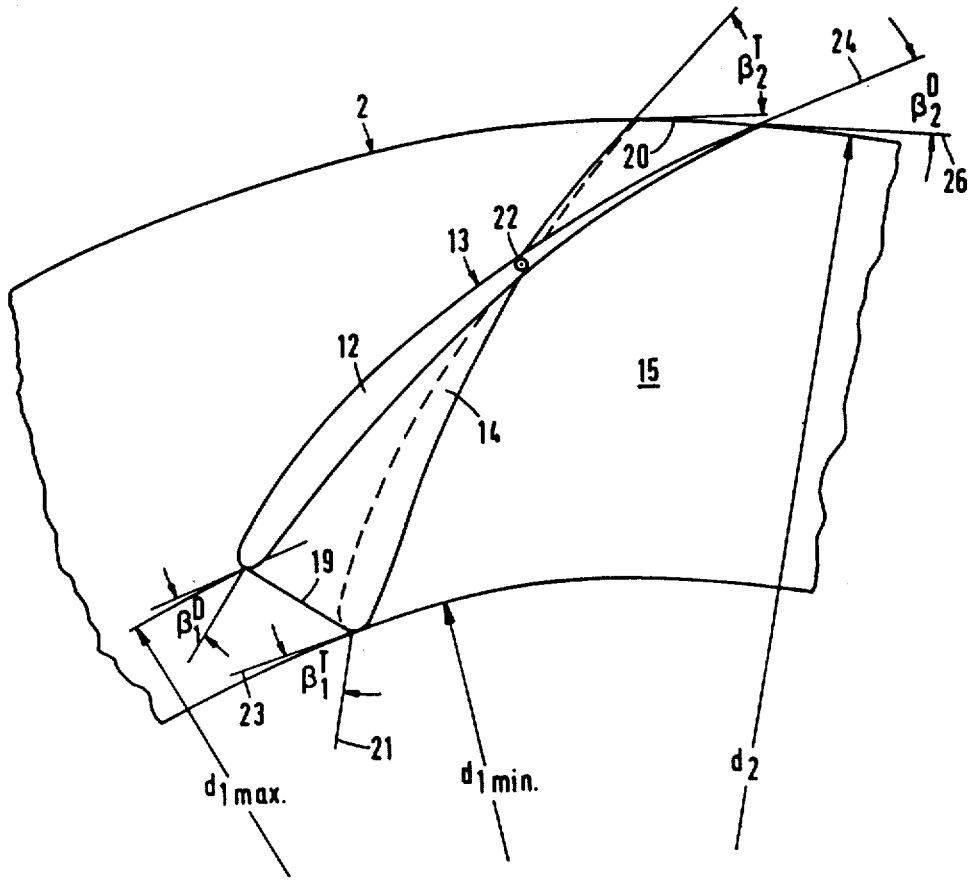
FIG. 3 is a plan view of a twisted blade of the impeller as marked III in FIG. 1.

As may be seen from FIG. 3, the blades 13 are as such twisted so that the inner edges 19 and the outer edges 20 of the blades are skewed on the surfaces of rotation enveloping them, or in other words they are not parallel to the axis of turning of the radial impeller 2. As in FIG. 1, in FIG. 3 as well the blade 13 is being viewed looking down onto the support plate 15. The cover plate 8 otherwise fixed on the top ends 12 of the blades 13 has been taken off. The lower ends 14 (that will be seen to be partly covered over) of the blade 13 is fixed to the support plate 15. Because of the twisted form of each blade 13 there is a change of the blade entry angle $\beta_1$ and of the blade exit angle $\beta_2$ with the height of the radial impeller. In this respect the blade entry angle $\beta_1$ is defined in planes that are parallel to the support plate 15. The angle is in each case formed between an airfoil middle or center line 21 of the blade 13 on the one hand and a tangent 23 to the surface of rotation formed by the blade inner edges 19 on the other hand. In the same planes parallel to the support plate 15 the blade exit angle $\beta_2$ is defined as well. It is formed in each case between one airfoil middle line 24 of the blade 13 on the one hand and a tangent 26 to the surface of rotation described by the outer edges 20 of the blades on the other hand. In the FIG. 3 the blade entry angle $\beta_1^D$ on the cover plate side and the blade exit angle $\beta_2^D$ on the cover plate side have been marked at the level of the cover plate 8. The blade entry angle $\beta_1$ on the support plate side and the blade exit angle $\beta_2^T$ on the same side, on the other hand are marked at the level of the support plate 15. As will readily be seen from FIG. 3, because of the twisted form of the blades 13 $\beta_1^D$ is smaller than $\beta_1^T$ and furthermore $\beta_2^D$ is smaller than $\beta_2^T$.

It is further to be seen from FIG. 3 that the blade 13 has an airfoil form that is of special value in connection with the desired flow or aerodynamic properties. The airfoil form may be seen specially clearly at the top cover plate side 12 and the support plate lower side 14 of the said blade. The airfoil form is like that of the wing of an airplane designed for low speeds, that is to say speeds up to about 250 km/h. The blade 13 has such an airfoil form over its full height, that is to say between the cover plate 8 and the support plate 15. Every section taken through a blade 13 in a plane parallel to the support plate 15 will for this reason have the same section as that of an airfoil of the sort noted. In terms of the direction of turning of the radial impeller 2 the airfoil form of the blade 13 is curved backwards. The exit angle $\beta_2$ of the blade does for this reason have values of less than 90°. A further point is that the airfoil is twisted in the way figured.

In keeping with the invention the desired high power concentration of the radial fan is made possible inasfar as with a ratio of the mean inner blade diameter $\overline{d_1}$ to the outer diameter of the blade $d_2$ of about 0.7 to 1 the blades 13, made with the form of a airplane wing profile, are so designed that the cover plate side blade entry angle $\beta_1^D$ is 4° to 7° smaller than the support plate side blade entry angle $\beta_1^T$. And furthermore the cover plate side blade exit angle $\beta_2^D$ is 3° to 6° smaller than the support plate side exit angle $\beta_2^T$, while the cover plate side blade entry angle $\beta_1^D$ is between 14° and 20° and the cover plate side blade exit angle $\beta_2^D$ is between 39° and 45°. Wide ranging tests have now made it clear that with sizes in the given range the best performance data for a radial fan may be produced. The given angle ratios may be produced by twisting the blades 13 or in other ways.

In the case of a preferred form of the invention the cover plate side blade entry angle $\beta_1^D$ is equal to 14.5° to 17.5° and the support plate side blade entry angle $\beta_1^T$ is 21.5°, whereas the cover plate side blade exit angle $\beta_2^D$ is equal to between 40° and 43°. The cover plate side blade exit angle $\beta_2^T$ is equal to 46°.

Figure 4:
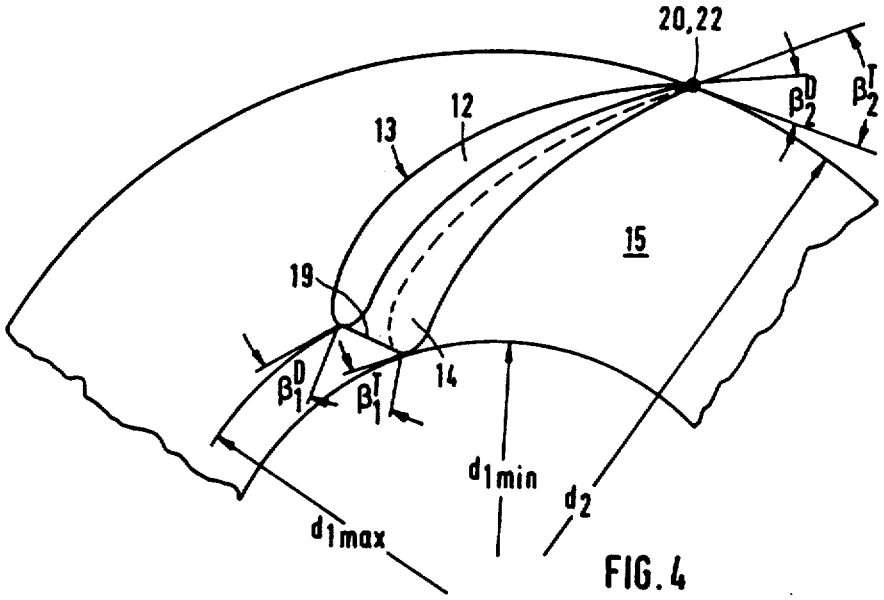
FIGS. 4 and 5 are views of further possible forms of blade as seen in a plan view like that of FIG. 3.

The blade form to be seen in FIG. 3 is produced by twisting about a twist axis 22 running normally to the plane of the figure. The twist axis 22 is for this reason parallel to the axis of turning of the radial impeller 2. It is placed in a middle part of the blade 13. However such a design is not necessary in all cases and in fact the angle ratios noted herein may furthermore be produced if the twist axis 22 of the blade 13 is at the outer edges 20 of the blades. Such a further possible form of the invention is viewed in FIG. 4, in which again the structure is to be seen looking in the same direction as in FIG. 3. Parts with the same function as in FIG. 3 are given the same part numbers. The blade 13 to be seen here has an airfoil like section and is curved backwards. It outer edge 20 is parallel to the axis of turning of the radial impeller 2 so that it may be thought of stretching upwards from the plane of the paper. The axis 22 of twist is at the outer edge of the blade 13. Because of the twisted form of the blade the entry edge 19 is at a slope in relation to the axis of turning of the radial impeller 2 and the inner diameter of the blade may be seen to be different at different levels of the blade as was the case in FIG. 3. It will be seen in the system of FIG. 4 that because of the twist the cover plate side entry angle $\beta_1^D$ is smaller than the support plate side blade entry angle $\beta_1^T$, and on the same lines the cover plate side blade exit angle $\beta_2^D$ is smaller than the cover plate blade exit angle $\beta_2^T$. This being so, the given angle ratios may as well be produced by twisting about a twist axis 22, that is near or at the outer edges 20.

Figure 5:
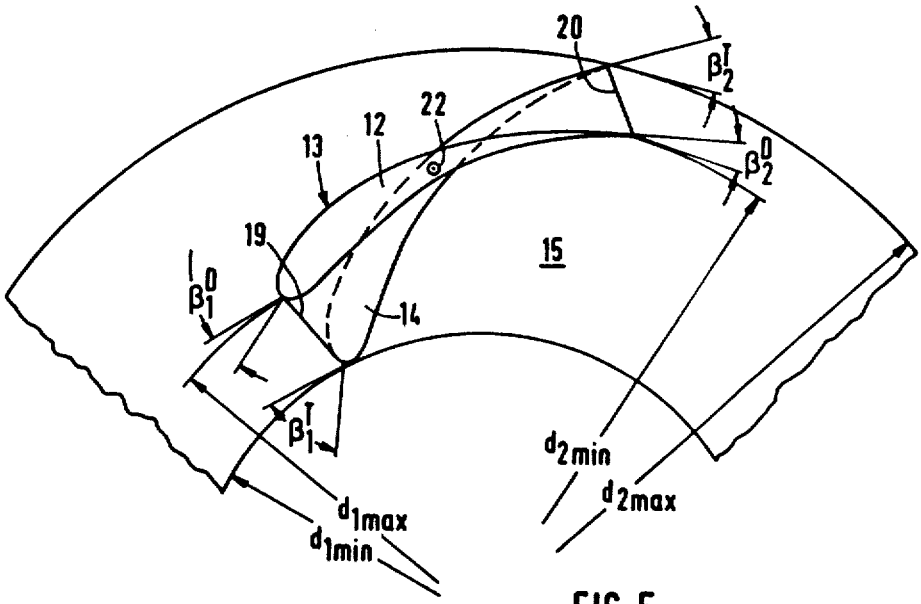

In FIG. 5 the reader will see a further possible working example of a twisted blade 13. In this case the twist axis 22 running parallel to the twist axis of the radial impeller 2 is placed in the middle part of the blades 13. As was the case with the working examples of FIGS. 3 and 4 the blade inner edge 19 is at such a slope that the surface thought of as enveloping all the blade inner edges 19 takes the form of a cone becoming narrower from the cover plate 8 to the support plate 15. That is to say, the inner diameter of the blades as measured at the level of the cover plate 8 is greater than at the level of the support plate 15. In keeping with FIG. 5 it will be seen that the outer edge 20 of the blades 13 is placed at a slope or angle in the same sort of way because of the twist about the twist axis 22. The surface of rotation eveloping all the blade outer edges 20 has the form of a conical face becoming wider from the cover plate 8 to the support plate 15. In a way different to the working example of FIG. 3 in the form of FIG. 5 the blade's outer edge is not formed by a single blade outer diameter $d_2$ that is more or less unchanging right over the full height of the blade 13. In fact, there is a change of the blade outer diameter with the height of the blade 13, it having its lowest value $d_{2min}$ at the level of the cover plate 8 and the greatest value $d_{2max}$ at the level of the support plate 15. For the ratio as claimed herein of the blade inner diameter to the blade outer diameter a mean blade outer diameter $\overline{d_2}$ is to be used in calculations. As the reader will at once see, in this design as well there are the said angle ratios so that the fan is fully in keeping with the teachings of the present invention.

Figure 6:
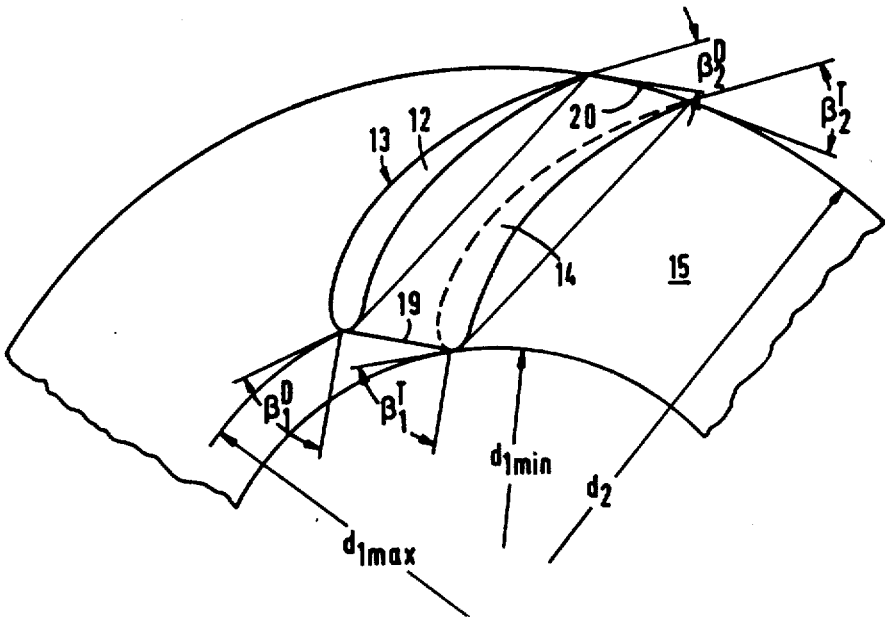
FIG. 6 is a view of a further possible form of the invention with an untwisted, sloping blade as seen in plan as in the view of FIG. 3.
Figure 7:
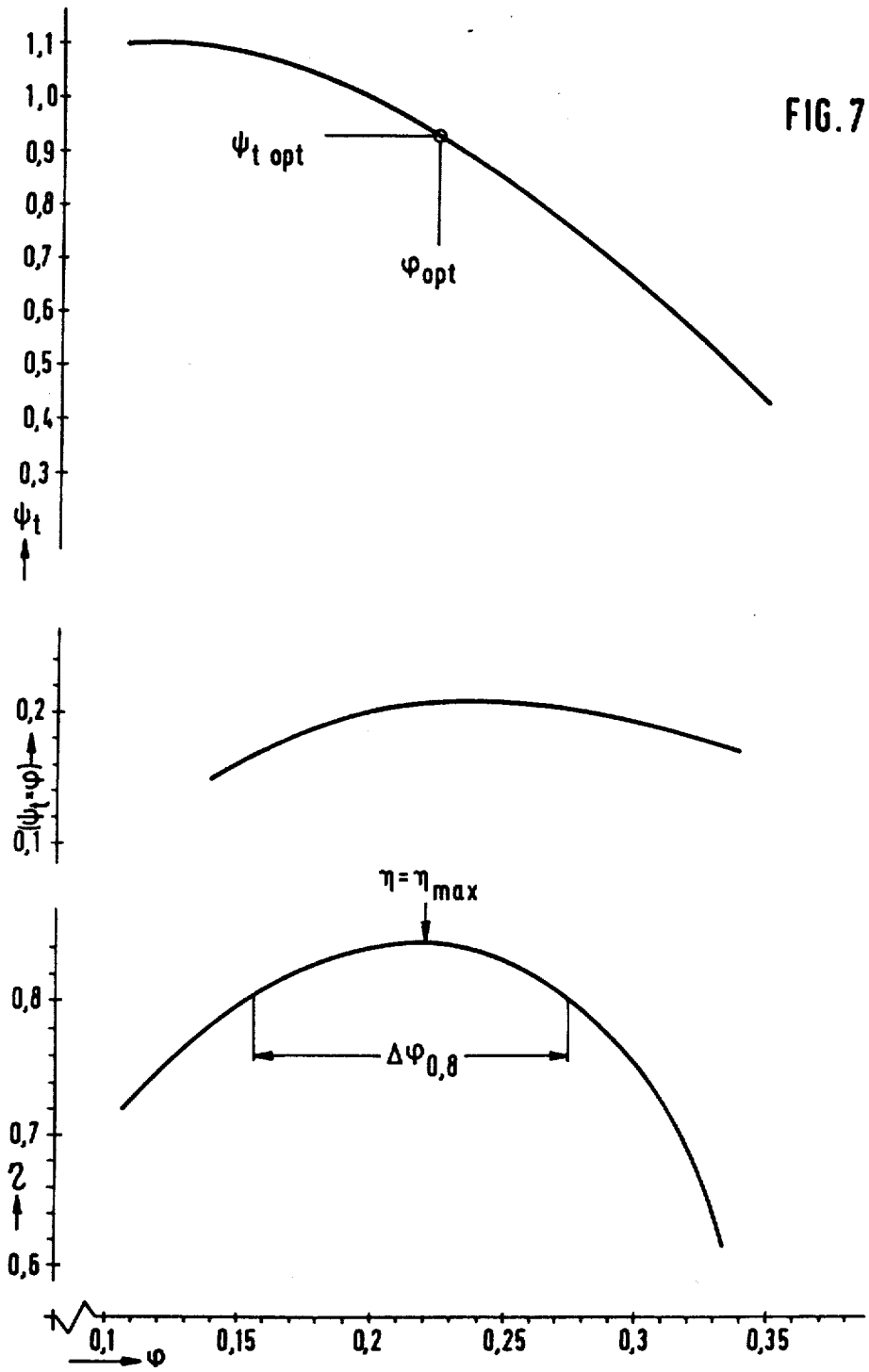
FIG. 7 is a plot of the characteristic of a radial fan in keeping with the present invention to give the relation between $\psi_t$ and $\eta$ on the one hand and $\phi$ on the other.

FIG. 6 is a view of a still further possible form of blade, which is not based on a twisted from of the blades airfoil but on a deformation by shearing normal to the length direction of the blade 13. Because of this shearing effect the blade 13 is at a slope, when looked at from the cover plate 8 towards the support plate 15, in a direction opposite to the direction of turning of the radial impeller 2. The outer edges 20 of the blades in this case have a generally constant diameter $d_2$ over the height of the blades 13. On the other hand the inner edges 19 of the blades are put at such a slope, because of the deforming or shearing effect, that the surface enveloping them or their envelope curve takes the form of a funnel-like surface of rotation becoming narrower from the cover plate 8 to the support plate 15. The blade 13 does for this reason have a large diameter to its inner edge 19 at the level of the cover plate 8 than at the support plate 15. For this reason a line normal to the support plate 15 running to the blade's inner edge 19 will be at an acute angle to the inner blade edge 19 not only in a tangential but furthermore in a radial projection with respect to the axis of rotation of said fan. It will now be seen from FIG. 6 that in the case of such a sloping blade 13 as well the cover plate side blade entry angle $\beta_1^D$ is smaller than the support plate side blade entry angle $\beta_1^T$ and furthermore the cover plate side blade exit angle $\beta_2^D$ is smaller than the support plate side exit angle $\beta_2^T$. The angle ratios in keeping with the present invention may furthermore be produced by a shearing or deforming effect on an airfoil-like backwardly curved blade 13 and not only by twisting. Generally speaking geometrical operations may be used for this purpose in which the blade inner edges 19, that in the first place were lined up parallel to the axis of turning of the radial impeller 2, and the blade outer edges 20 are changed so as to be on the skew in relation to the axis of turning. Furthermore the system of the invention may be so structured that the chords of the airfoils at sections through the blades along the blade width are in different planes perpendicular to the support plate 15 relative to the main radial direction of flow at the chord.

The present invention makes possible a radial fan whose power density, that is to say the product of $\phi_{opt}$ and $\psi_{topt}$ is greater than 0.2 at a volume number $\phi_{opt}$ of approximately 0.2 and more and for this reason is greater than the density in all prior art radial fans. At the same time the volume number range $\Delta\phi_{0.8}$, within which the radial fan may be run with an efficiency of more than 80%, has been increased so that it is better than the prior art at both sides or edges of the range by at least 20%. In order to make this clear attention is now to be given to the $\phi-\psi_t$ characteristic curve of the radial fan in keeping with the present invention. In this graph the efficiency $\eta$ has been plotted against $\phi$ using a separate scale. It will be seen that the efficiency $\eta$ gets to its higher value $\eta_{max}$ at a volume number of coefficient $\phi_{opt}$ of 0.215. The parallel value $\psi_{topt}$ is over 0.94 so that the power density as the product of $\phi_{opt}$ and $\psi_{opt}$ is over 0.2. It will furthermore be seen that on the two sides of the highest value $\eta_{max}$ of efficiency the same only goes down a very small amount in relation to the increasing and decreasing volume number $\phi$. The range $\Delta\phi_{0.8}$, in which the efficiency $\eta$ gets greater than 0.8, goes along a range of volume numbers $\phi$, that is very much larger than in the prior art. The invention does in fact make possible a radial fan that is much more compact that has so far been possible in the prior art, the fan furthermore running with a high efficiency even clear of the optimum point or position.

In order to be certain of producing this effect it is important, as noted hereinbefore, to have the entry inner edges 19 of the blades 13 so that they are at a slope in relation to the axis of turning of the radial impeller 2. This slope may be produced in a specially simple way, as may be seen more specially from the view of FIG. 3, if the blades are produced by bending them from a piece of sheet metal with two parallel edges, the said edges being placed against each other when the blade is fixed in position, such edges then forming the outer edge 20 of the blade. If the blades are now so fixed to the support plate 15 that the envelope plane of the outer edges 20 of the blades is a cylindrical surface of rotation then with the given amount of twist of the blades 13 there will be the desired slope of the inner edges 19 of the blades. That is to say, a blade form is possible in which the sides forming the blade outer edges 20 are at a right angle to the sides forming the limits of the lower side 14, resting on the support plate 15, of the blade 13. Such a form of blade is of great value from the point of view of production engineering inasfar as less waste is produced and the manufacturing operations are simpler.

Some size ratios for the radial fan of the present invention will now be given, in which the fan has the best or optimum performance data. In this respect one size or dimension important for the invention is the entry diameter $d_0$ of the cover plate 8, that is to say the smallest diameter of its inlet part. The entry diameter $d_0$ is marked in FIG. 2. In keeping with the present invention the ratio between it and the outer diameter $d_2$ of the blades is to be about 0.75 to 1.

A further item of design that is important for the radial fan of the invention is furthermore the form of the guiding contour 11 of the cover plate 8. This plate is in the form of a conic section, that is to say circular, parabolic or hyperbolic and is for this reason described by one or more radiuses of curvature r (FIG. 2).

In FIG. 2 a circular curvature of the guide contour 11 will be seen with one single radius r of curvature. For optimum performance data of the radial fan the radius or radiuses of curvature r have to have of ratio to the entry diameter $d_0$ within a range of 0.2:1 to 0.3:1.

For the function of the invention a further important point is the exit width $b_2$ of the radial fan, that is to say the distance between the support plate 15 and the cover plate 8 at the blade exit edge 20. The exit width $b_2$ in the case of the radial fan with aspiration on the two sides thereof as in FIG. 2 is in each case related to one half side of the radial impeller 2. The ratio of the exit width $b_2$ to the outer diameter of the blades $d_2$ is to be in a range of 0.225:1 to 0.275:1 and more specially it is to be 0.25:1. In place of using the outlet or exit width $b_2$ in working out the design the exit area $F_2$ of the radial fan may be used, that is to say the size of the area of the cylindrical envelope curve of the blade outer edges 20. The outlet or exit area $F_2$ is defined by the exit width $b_2$ and the outer blade diameter $d_2$. It is best related to the entry area $F_0$ of the radial impeller 2, that is to say the clearance width of the inlet part of the cover plate 8 with the entry diameter $d_0$. In keeping with the invention the ratio of the entry area $F_0$ of the radial impeller 2 to its exit area $F_2$ is to be in a range of 0.51:1 to 0.62:1 and more specially is to have a value of 0.56:1.

The optimum dimensions or proportions of the radial fan in keeping with the invention lastly have to take into account the ratios between the different dimensions of the spiral housing 1, in which respect the entry area $F_E$ of the inlet cowl 5 and the cross section $F_A$ of the exit area 16 of the spiral housing are of interest. The size of the exit area $F_A$ is marked in FIG. 1 and the clearance width $F_E$ of the inlet cowl 5 is marked in FIG. 2. The ratio of $F_E$ to $F_A$ is to be in a range of 0.67:1 to 0.71:1, the preferred value being 0.69:1

It is to be noted that the given dimensional ratios are to be used not only for radial fans with aspiration on one side only but furthermore for such fans with aspiration on both sides. In the last-named case it is true that the absolute numerical values are doubled, the ratios however are kept unchanged.

Lastly a further factor of importance for the performance data of the radial fan in keeping with the invention is the number of the blades 13 spaced out round and on the radial impeller. The number of blades is to be between 10 and 16. In a preferred form of the invention there are 12 blades 13.

The design in keeping with the invention of a radial fan is equally possible with aspiration on one single side or on both sides, the last named system being seen in FIG. 2. This form of the invention is more specially used in air conditioning apparatus and air conditioning plant.

Figure 8:
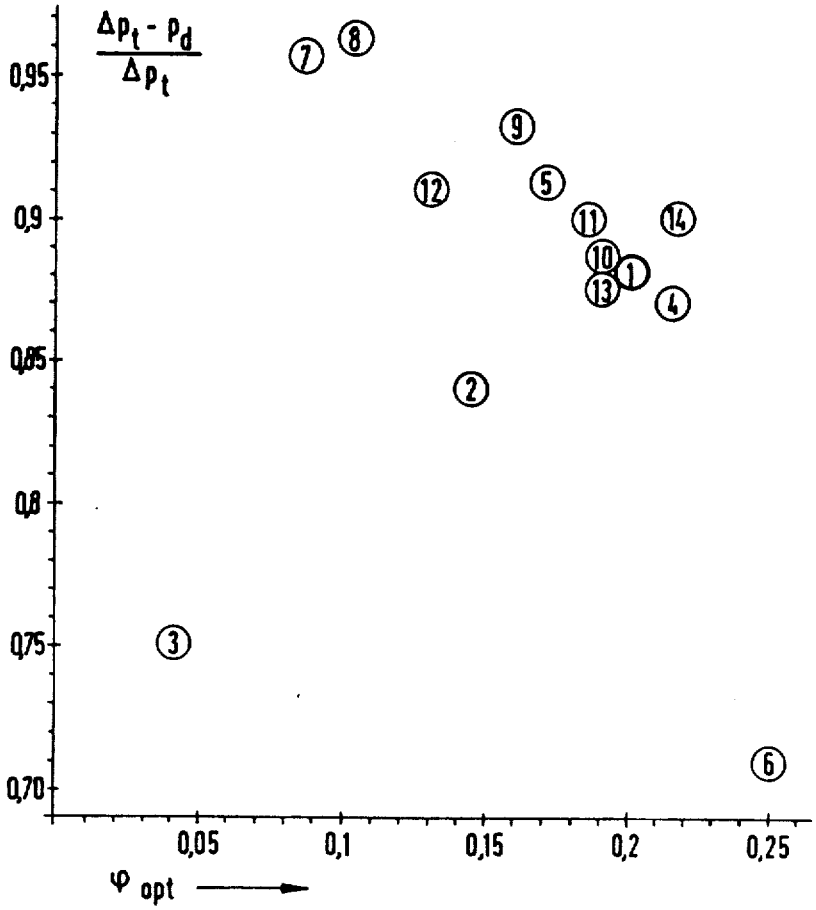
FIG. 8 is a plot of the degree of reaction of the radial fan of the present invention at the optimum point in comparison with radial fans of the prior art.

In addition to the useful effects noted herein before, the radial fan in keeping with the invention makes possible a very high degree of reaction, that is to say the quotient of static pressure/overall pressure. Because this is so the proportion of the kinetic energy that at first may not be used is very small. FIG. 8 makes possible a comparison between the radial fan in keeping with the invention and such fans of the prior art. In this respect the degree of reaction is plotted against the volume numbrer $\phi$ at the highest efficiency $\eta_{max}$, that is to say at the optimum point $\phi_{opt}$. It will be seen that prior art fans have values of 1 to 13 and a fan of the invention has a value of 14 and that the value of 14 in keeping with the invention is the best possible compromise between the need for the highest possible volume number and a high degree of reaction.

Furthermore the invention makes possible an apparatus in which the shaft horsepower takes on a maximum value within the given volume number range covered, that is to say it becomes possible for the driving motor of the radial fan to be designed to be in harmony with the maximum of the shaft power so that on running the fan under conditions that are different to the operating point for which it was designed overloading is not to be feared. In this respect the radial fan or blower in keeping with the invention may be said to have the edge over a drum impeller fan with forwardly curving blades, in the case of which the shaft power goes up with an increase in the volume flow, that is to say with an increase in the volume number $\phi$, progressively, and there is no maximum at all. Because of this there will always be a danger of overloading the motor driving such a fan. This shortcoming is not present with the radial fan in keeping with the invention, which on the other hand is very like a drum impeller fan with respect to the power density so that invention gives the useful effects of a radial fan with backwardly curved blades while at the same time profiting from the useful properties of a drum impeller fan. The highest permissible peripheral speed of the radial fan of the invention, as measured at the outer edges 20 of the blades, is about 85 m/sec. Such a high permissible peripheral speed makes it possible, for operation at a given point or performance, the use of small fans so that the price of the plant is cut down. Because of the power density possible the radial fan in keeping with the invention with a specific speed of rotation of $n_q$ of about 80 comes within the semi-axial fan performance class.

Further useful effects and the importance of the design parameters of the invention will now be made clear on the footing of two examples.

FIRST EXAMPLE

A comparison was undertaken between a fan (fan I) having airfoil blades with angles outside the range of the invention and a radial fan (fan II) in keeping with the invention. But for the design data to be listed hereinafter the two fans were the same with respect to sizes and size ratios and proportions and the number of blades.

Fan I: blade entry angle $\beta_1{}^D = 35°$
$\beta_1{}^T = 23°$
blade exit angle $\beta_2 = 48°$
$\bar{d}_1{:}d_2 = 0.7$
$\psi_{topt} \cdot \phi_{opt} = 0.182$ with $\phi_{opt}$ equal to 0.2
Range of $\Delta\ \phi_{0.8}{:}\phi = 0.145$ to 0.265.

Fan II: blade entry angles $\beta_1{}^D = 17.5°$
$\beta_2{}^D = 21.5°$
blade exit angle $\beta_2{}^D = 42°$
$\beta_2{}^T = 46°$
$\bar{d}_1{:}d_2 = 0.7$
with $\psi_{opt} \cdot \phi_{opt}$ equal to 0.202 with $\phi_{opt}$ equal to 0.215
Range of $\Delta\ \phi_{0.8}{:}\phi = 0.13$ to 0.274.

From this it will be seen that the radial fan of the invention outdoes the prior art fan.

The characteristic curve of a fan in keeping with the invention is highly dependent on the blade angles and the twist of the blades.

This will now be made clear using the example of fans III and IV, which had blade parameters outside the range of the invention while other parameters were within same.

Fan III: blade entry angle $\beta_1{}^D = 16°$
$\beta_1{}^T = 23°$
Blade exit angle $\beta_2{}^D = 40.5°$
$\beta_2{}^T = 47.5°$
$\psi_{topt} \cdot \phi_{opt} = 0.2$ with $\phi_{opt}$ equal to 0.195
Range of $\Delta\phi_{0.8}$: = 0.158 to 0.244.

It will be seen from this that overtwisting the blades is responsible for less good performance data.

Fan IV: blade entry angles $\beta_1{}^D = 12°$
$\beta_1{}^T = 18°$
Blade exit angle $\beta_2{}^D = 48°$
$\beta_2{}^T = 52°$
$\psi_{topt} \cdot \phi_{opt} = 0.189$ with $\phi_{opt}$ equal to 0.21

That is to say $\eta_{max}$ was 0.79, it falling short of 0.8.

It will be seen from this that if the blade angle adjustment is wrong the useful properties are not produced even if the blades are twisted or the blades are deformed with a shear effect.

SECOND EXAMPLE

A comparison was made between radial fans with the airfoil blades with the degree of slope as in the invention for the purpose of measuring the effects of changes in the inner and outer diameters of the blades.

Fan II: with $\bar{d}_1{:}d_2$ equal to 0.7, see example 1.

Fan V, like fan II but with $\bar{d}_1{:}d_2$ equal to 0.6

$\psi_{topt}{\cdot}\phi_{opt}$ equal to 0.18 at $\phi_{opt}$ equal to 0.2

The range of $\Delta\phi_{0.8}$ was $\phi$=0.16 to 0.27.

We claim:

1. A radial fan comprising a spiral housing, a radial impeller fitted in said housing for turning motion therein, a support plate on one side of said impeller, a cover plate on an opposite side of said impeller, means defining an inlet cowl of said fan, said cowl being overlapped by said cover plate at a rounded guide thereof, said impeller having backwardly curving, generally airfoil-like blades with inner edges running at a slope in relation to an axis of turning of said impeller, said blades having an inner diameter decreasing from said cover plate to said support plate, the ratio between the mean inner diameter of said blades and the outer diameter thereof being generally equal to 0.7 to 1, the blades having an entry angle at the cover plate side that is 4° to 7° less than the entry angle thereof at the support plate side, said blades further having an exit angle at the cover plate side that is 3° to 6° smaller than the blade exit angle at the support plate side, the said blade entry angle at the cover plate side being between 14° and 20° and the blade exit angle at the cover plate side being between 39° and 45°.

2. The radial fan as claimed in claim 1 wherein the said blade entry angle on the cover plate side is between 14.5° and 17.5° and the blade entry angle on the support plate side is 21.5°.

3. The radial fan as claimed in claim 1 wherein the blade exit angle on the cover plate side is 40° to 43° and the blade exit angle on the support plate side is 46°.

4. The radial fan as claimed in claim 1 wherein said blades have a twisted form.

5. The radial fan as claimed in claim 4 wherein the blades have a twist axis in a middle part thereof.

6. The radial fan as claimed in claim 4 wherein the blades have a twist axis at the outer edges of the blades.

7. The radial fan as claimed in claim 4 wherein the blades have a twist axis parallel to the axis of turning of the radial impeller.

8. The radial fan as claimed in claim 1 wherein the blades are free of twist and are deformed by a shearing effect in a direction normal to the length direction of the blades.

9. The radial fan as claimed in claim 1 wherein as seen in a direction looking from the cover plate to the support plate the blades are at a slope opposite to the direction of turning of the radial impeller, said blade inner edges making an acute angle in both a tangential and a radial projection with respect to a line normal to the cover plate.

10. The radial fan as claimed in claim 1 wherein the inner edges of said blade are skewed in relation to the axis of turning of the radial impeller.

11. The radial fan as claimed in claim 1 wherein the airfoil chords of section of said blades along the blade width are in different planes perpendicular to the support plate relative to the main radial direction of flow at said chords.

12. The radial fan as claimed in claim 1 wherein said blades are each made up of a piece of sheet metal with two parallel edges and which has been bent into the form of the blade with said parallel edges placed together in the form of the outer edge of said blade.

13. The radial fan as claimed in claim 1 wherein the cover plate has an inlet diameter, the ratio thereof to the outer diameter of the blades being roughly 0.75 to 1.

14. The radial fan as claimed in claim 1 wherein the said rounded guide is in the form of a conic section and the ratio of the at least one radius of curvature of such guide to an air inlet diameter of the fan is in a range of 0.2:1 to 0.3:1.

15. The radial fan as claimed in claim 1 wherein a first ratio between an outlet width of the said radial impeller to the outer diameter of the blades is in a range of 0.225:1 to 0.275:1.

16. The radial fan as claimed in claim 15 wherein said first ratio is equal to 0.25:1.

17. The radial fan as claimed in claim 1 wherein a second ratio between an inlet surface area of the said radial impeller to an outlet surface area thereof is in a range of 0.51:1 and 0.62:1.

18. The radial fan as claimed in claim 17 wherein said second ratio is equal to 0.56:1.

19. The radial fan as claimed in claim 1 wherein a third ratio between a clearance width of the said cowl to an outlet surface area of the spiral housing is between 0.67:1 and 0.71:1.

20. The radial fan as claimed in claim 19 wherein said third ratio is equal to 0.69:1.

21. The radial fan as claimed in claim 1 wherein the number of said blades is between 10 and 16.

22. The radial fan as claimed in claim 21 wherein the number of said blades is 12.

23. The radial fan as claimed in claim 1 designed for aspiration on two sides of said impeller, said support plate being at a middle plane of said impeller and having said blades on both sides thereof.

* * * * *